US006137511A

United States Patent [19]

Furuhata et al.

[11] Patent Number: 6,137,511

[45] **Date of Patent: *Oct. 24, 2000**

[54] INK JET RECORDING HEAD HAVING AN INK RESERVOIR COMPRISING A PLURALITY OF GROOVES WITH INCREASED STRENGTH AND VOLUME CAPACITY AND INK JET RECORDING APPARATUS HAVING THE SAME

[75] Inventors: Yutaka Furuhata; Yoshinao Miyata, both of Nagano, Japan

[73] Assignee: Seiko Epson Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/832,626

[22] Filed: Apr. 4, 1997

[30] Foreign Application Priority Data

Apr. 5, 1996 [JP] Japan ..... 8-083644
Mar. 27, 1997 [JP] Japan ..... 9-076251

[51] Int. Cl.[7] ..... B41J 2/045

[52] U.S. Cl. ..... 347/70

[58] Field of Search ..... 347/70, 72, 94, 347/71, 68

[56] References Cited

U.S. PATENT DOCUMENTS 5,265,315 11/1993 Hoisington et al. ..... 29/890.1

FOREIGN PATENT DOCUMENTS 600382 6/1994 European Pat. Off. .
678387 10/1995 European Pat. Off. .
5-286131 11/1993 Japan ..... B41J 2/045
92/09111 5/1992 WIPO .

OTHER PUBLICATIONS

Patent Abstracts of Japan, vol. 18, No. 289 (M–1614), Mar. 1, 1994 (Seiko Epson Corp.).
Patent Abstracts of Japan, vol. 18, No. 526 (M–1683), Jul. 5, 1994 (Fuji Xerox Co. Ltd.).
Patent Abstracts of Japan, vol. 18, No. 452 (M–1661), May 24, 1994 (Fuji Electric Co. Ltd.).
Patent Abstracts of Japan, vol. 12, No. 208 (M–709), Jan. 18, 1988 (Canon, Inc.).
Patent Abstracts of Japan, vol. 18, No. 565 (M–1694), Jul. 26, 1994 (Fujitsu Ltd.).
Patent Abstracts of Japan, vol. 18, No. 243 (M–1602), Feb. 8, 1994 (Seiko Epson Corp.).
Patent Abstracts of Japan, vol. 17, No. 552 (M1491), Jun. 22, 1993 (Seiko Epson Corp.).

*Primary Examiner*—John Barlow
*Assistant Examiner*—C Dickens
*Attorney, Agent, or Firm*—Sughrue, Mion, Zinn, Macpeak & Seas, PLLC

[57] ABSTRACT

An ink jet recording head which can compensate for shortage of mechanical strength of an ink reservoir by preventing the piezoelectric film on an ink reservoir from cracking or being broken due to the vibration of a piezoelectric film or flowing or mechanical vibration of ink. The ink reservoir has at least two plane orientations at its bottom and is given different depths.

18 Claims, 9 Drawing Sheets

INK JET RECORDING HEAD HAVING AN INK RESERVOIR COMPRISING A PLURALITY OF GROOVES WITH INCREASED STRENGTH AND VOLUME CAPACITY AND INK JET RECORDING APPARATUS HAVING THE SAME

DETAILED DESCRIPTION OF THE INVENTION

1. Technical Field of the Invention

The present invention relates to an ink jet recording head used for an ink jet recording apparatus. In particular, the present invention is directed to an ink jet recording apparatus that is used for forming a recorded image based on image data, onto a recording medium such as paper, by jetting ink drops. More particularly, the present invention is directed to an ink jet recording head in which pressure generating chambers, ink supply paths and an ink reservoir are formed in a single-crystal silicon (Si) substrate.

2. Description of the Related Art

An ink jet recording head has a pressure generating chamber, a part of the pressure generating chamber communicating with a nozzle opening for jetting ink drops is made of an elastic plate and the elastic plate is deformed by a piezoelectric oscillator to pressurize the ink in the pressure generating chamber so that the ink drops are jetted from the nozzle opening.

There are two types of such ink jet recording heads. One type uses a piezoelectric oscillator in a vertical oscillation mode which expands or contracts in the axial direction. The other type uses a piezoelectric oscillator in a warping oscillation mode.

The former has an advantage that the volume of the pressure generating chamber can be changed by abutting the end face of the piezoelectric oscillator on the elastic plate, thereby permitting a head suited for high density printing to be fabricated. However, the fabrication process is complicated because it requires a difficult step of cutting the piezoelectric elastic plate into piezoelectric oscillators of an interdigitated shape in agreement with the arrangement of the pitch of the nozzle openings. In addition, another step of placing the divided piezoelectric oscillators in a pressure generating chamber is required.

The latter kind of head has an advantage that a piezoelectric body can be provided on an elastic plate by a relatively simple step of applying a green sheet of a piezoelectric material to the pressure generating chamber in accordance with its shape and baking it. However, this kind of head has a disadvantage that a relatively large area is required due to the warping oscillation, thus making a high density arrangement difficult.

In order to obviate the disadvantage of the latter recording head, JP-A-5-286131 proposes a technique of forming a uniform piezoelectric film on the entire surface of the elastic plate by filming and cutting the piezoelectric film into shapes corresponding to pressure generating chambers by lithography, thus forming individual piezoelectric oscillators for the respective pressure generating chambers.

Alternatively, international Laid-Open WO92/09111 discloses a technique of forming a piezoelectric film on one surface of a single-crystal Si substrate by filming, and making grooves constituting pressure generating chambers on the other surface thereof by etching and connecting a nozzle plate having nozzle openings on the surface to the grooves formed thereon, thereby providing an ink jet recording head. The proposal has an advantage that the piezoelectric oscillators can be provided by the precise and simple technique of lithography without requiring the step of cutting and placement of the piezoelectric elements, and the thickness can be decreased, thus permitting high speed driving.

The problem of the recording head using the filming technique of the above proposals is that since the piezoelectric material layer is very thin, the rigidity of the head is lower than the recording head with a bulk piezoelectric body applied.

An example of such an ink jet recording head is shown in FIGS. 9*a* and 9*b*, in which a silicon oxide film 902 is formed on a single-crystal Si substrate 901 of plane orientation (110). On the silicon oxide film 902, a vibrating plate 903, a lower electrode 904, a piezoelectric film 905 and an upper electrode 906 are integrally formed by a filming technique. On the single-crystal Si substrate 901, plural pressure generating chambers 907 and ink supply paths 908 communicating the pressure generating chambers 907 with the ink reservoir 909 and a nozzle plate 910 with nozzle openings 911 is sealed. The recording head may have a structure that includes wiring so that the piezoelectric film 905 and the upper electrode 906 are extended to the ink reservoir 909.

In such a structure, as shown in FIG. 9(*b*), when a voltage is applied to the piezoelectric film 905 by the upper and lower electrodes 906, 904, the piezoelectric film 905 contracts so that the oscillating plate warps towards arrow a. Thus, the pressure generating chambers 907 are pressurized to jet ink from the nozzle openings 911. In addition to the jetting of ink, the ink flows back from the ink supply openings to the reservoir 909. The ink flowed back enhances the pressure within the reservoir 909 so that the vibrating plate on the reservoir 909 is deformed and the lower electrode 904, piezoelectric film 905 and upper electrode 906 may be deformed. As the case may be, the piezoelectric film 905 cracks so that the ink jet recording head cannot be operated.

One method to solve such a problem, may include leaving a part of the single-crystal Si of the reservoir to increase the mechanical strength. In this method, however, the ink volume of the reservoir is decreased. Thus, for example, where ink is jetted from all the nozzles at a high speed, ink is not sufficiently supplied into the pressure generating chamber so that "dot omission" may occur. Increasing the size of the ink reservoir for the purpose of increasing the amount of ink supply reduces the mechanical strength so that the thickness of the portion opposite to the ink reservoir of the single-crystal Si film must be increased. This leads to the large scale of the recording head. In addition, it is very difficult to control the depth of the reservoir precisely.

SUMMARY OF THE INVENTION

The present invention solves the above problem by providing a small-size ink jet recording head which can enhance the mechanical strength of the ink reservoir so that the lower electrode, piezoelectric film and upper electrode do not crack and also provide for an adequate supply of ink.

In order to solve the above problem, an ink jet recording head according to the present invention comprises: a nozzle plate having a plurality of nozzle openings for discharging ink; a flow-path forming plate including a plurality of pressure generating chambers communicating with said nozzle openings, respectively, ink supply paths for supplying ink to said pressure generating chamber and a reservoir communicating with said ink supply paths; a vibrating plate formed on said flow-path forming plate; and a thin-film piezoelectric element having electrodes formed at the areas on said vibrating plate corresponding to said pressure generating chambers and a piezoelectric element, wherein said reservoir includes a common ink chamber and a plurality of grooves.

BRIEF DESCRIPTION OF THE DRAWINGS

The above objective and advantages of the present invention will become more apparent by describing in detail a preferred embodiment thereof with reference to the accompanying drawings in which:

FIG. 2(*b*) is a sectional view taken along line I—I'.

DETAILED DESCRIPTION OF THE INVENTION

Figure 1:
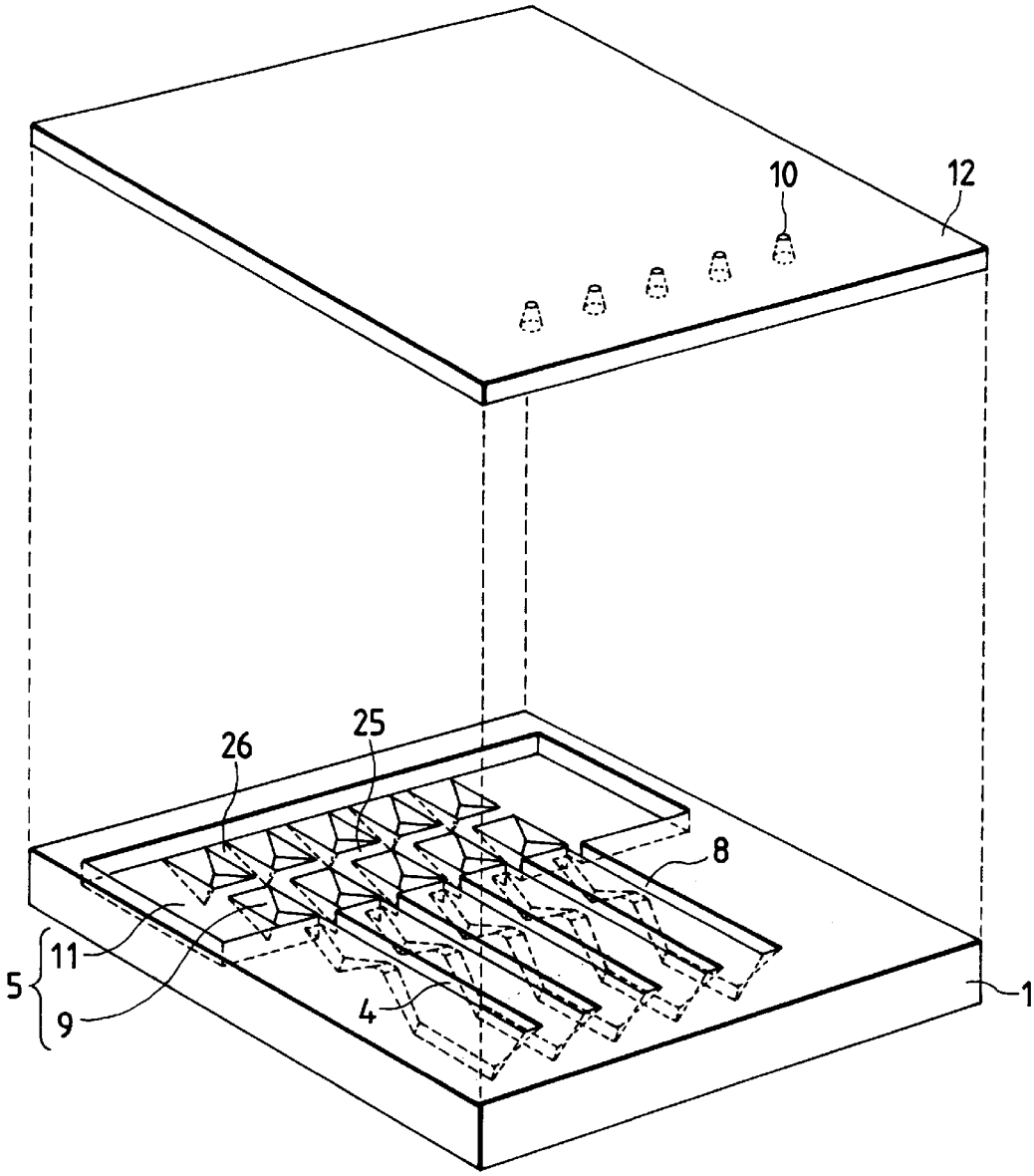
FIG. 1 is an exploded perspective view of the ink jet substrate and the nozzle plate according to the present invention.

Now referring to the drawings, an explanation will be given of the embodiments of the present invention.

Figure 2A:
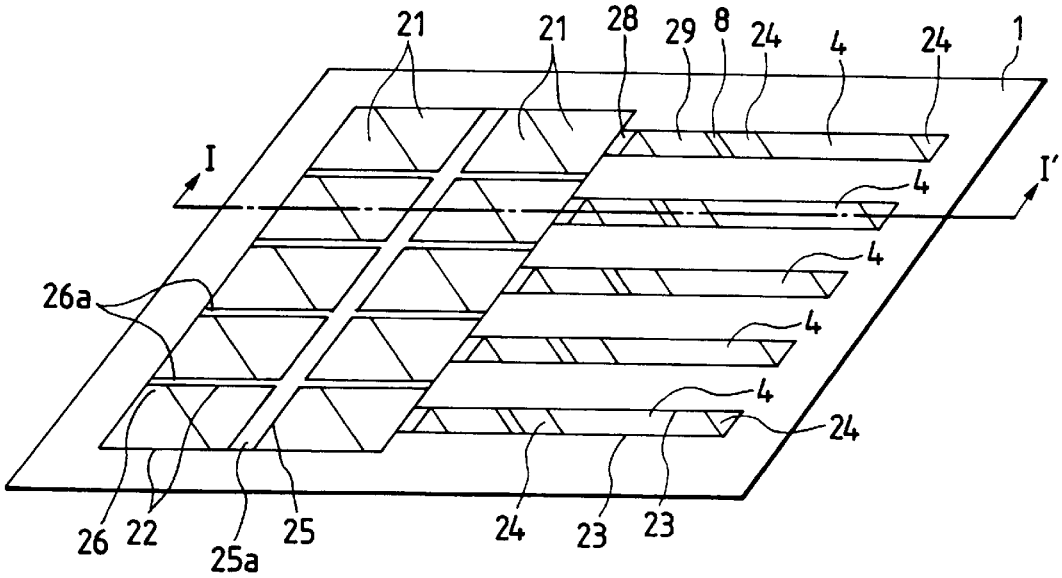
FIG. 2(*a*) is a plan view of the flow path forming substrate according to the present invention.
Figure 2B:
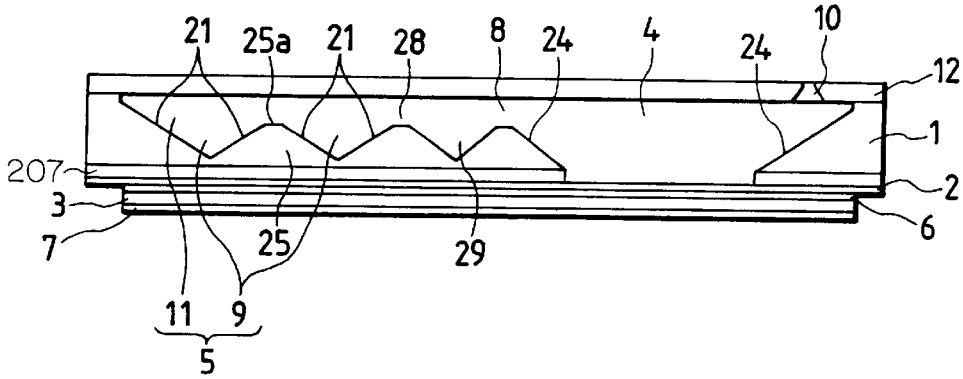
Figure 3A:
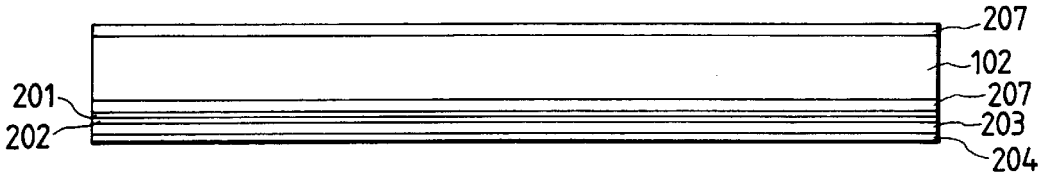
FIG. 3(*a*) to FIG. 3(*d*) are sectional views showing the process of fabricating the ink jet recording head according to the present invention.
Figure 3B:
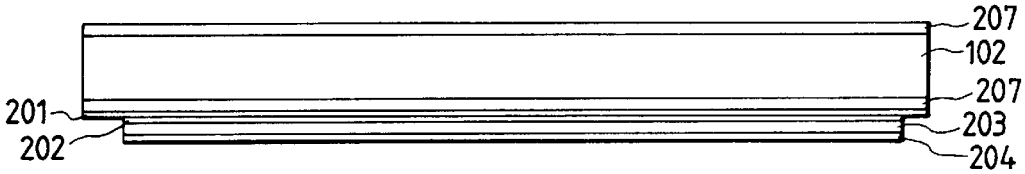
Figure 3C:
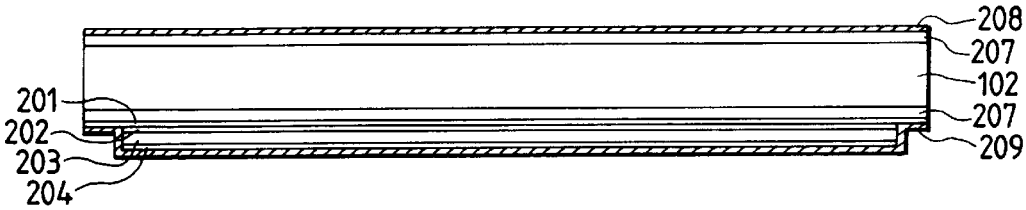
Figure 3D:
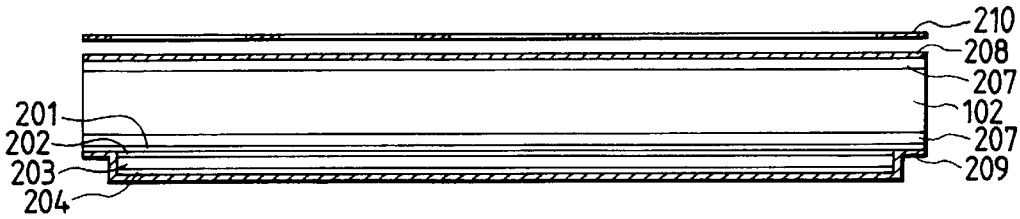

FIG. 1 is an exploded perspective view of the ink jet the flow path forming substrate and the nozzle plate according to the present invention. FIG. 2(*a*) is a plan view of a flow path forming substrate described below. FIG. 2(*b*) is a sectional view taken on line I—I' of FIG. 2(*a*).

In these figures, reference numeral 1 denotes a flow path forming substrate, or spacer, fabricated by etching a single-crystal Si substrate having a plane orientation of (110) including a plurality of pressure generating chambers 4; a reservoir 5 for supplying ink into these pressure generating chambers; and ink supply paths 8 for communicating these pressure generating chambers 4 with the reservoir 5 with constant fluid resistance. On the one side of the spacer 1, a nozzle plate 12 is secured in which a nozzle opening 10 is made to communicate with one end of the pressure generating chambers 4. On the other side of the flow path forming substrate 1, a vibrating plate 2 is formed. At the positions corresponding to the pressure generating chambers 4 on the vibrating plate 2, a lower electrode 6, a piezoelectric film 3 and upper electrode 7 are formed.

The reservoir 5 includes a common ink chamber 11 which is a single groove having a thickness equal to that of the ink supply paths 8 over the entire area of the reservoir 5, and a plurality of grooves 9 communicating with the common ink chamber 11, respectively. Each groove 9 has wall faces 21, 22. The wall face 21 is a (111) plane appearing at an angle of about 35° when the single-crystal Si with the plane orientation of (110) is anisotropically etched. The wall face 22 is a (111) plane having an angle of 90° from the plane orientation (110).

The respective grooves 9 are arranged so that they are partitioned by walls 25, 26 in a lattice form. The width of the plane 25*a* , which constitutes the bottom of the common ink chamber 11 of the wall 25 in a direction of the arrangement of the pressure generating chambers 4 at the center of the reservoir, is larger than that of the plane 26*a* of each of the walls 26 formed at the same pitch as that of the pressure generating chambers, which also constitutes the bottom of the common ink chamber 11, thus enhancing the strength of the reservoir.

Such a configuration of the reservoir can strengthen the mechanical strength of the reservoir and also provide a sufficient supply of ink without greatly increasing its size.

For example, with an ink jet amount of 20 $\mu$cc for each nozzle opening, when ink is jetted simultaneously from 10 nozzle openings at a rate of 14400 dots per 1 sec, the reservoir 5 is required to have a volume of 0.271 $mm^3$. Since the reservoir according to the present invention has grooves surrounded by the (111) planes formed by anisotropic etching and appearing at the angle of about 35° from the (110) plane, the volume of the reservoir 5 can be increased to 1.2 $mm^3$, thus assuring a sufficient amount of ink.

Although the arrangement pitch of the grooves 9 of the reservoir 5 is not limited particularly, it is preferable to arrange the grooves 9 at the pitch equal to that of the pressure generating chambers 4 so that the paths of supplied ink having the same shape can be provided for the pressure generating chambers. Thus, ink can be supplied to the pressure generating chambers 4 with no variation in the resistance of the flow path of ink so that the amount of ink supplied to the pressure generating chambers can be made uniform.

In this embodiment, although two columns of the grooves 9 of reservoir 5 were formed in a direction of arranging the pressure generating chambers 4, one or three or more columns of grooves 9 can be formed.

Each of the pressure generating chambers is formed by wall faces 24, 23. The wall face 24 is a (111) plane appearing at an angle of about 35° when the single-crystal Si with the plane orientation of (110) is anisotropically etched. The wall face 23 is a (111) plane having an angle of about 90° from the plane orientation of (110).

Incidentally, in FIG. 2(*a*) and 2(*b*), a groove 29 and a flow path 28 constitute a flow path for communicating the reservoir 5 with the ink supply paths 8. Since the width of the reservoir 5 is different from that of the ink supply paths 8, when the single-crystal Si substrate is etched, the shape of the connecting portion between the reservoir 5 and the ink supply paths 8 is apt to be unstable. But, by forming the flow path between the reservoir 5 and the ink supply paths 8, the ink supply paths 8 can be formed accurately. The groove 29 and flow path 28 may be omitted provided that the accuracy in fabrication can be assured.

An explanation will be given of the method of fabricating the ink jet recording head according to the present invention.

As shown in FIG. 3(*a*), a single-crystal Si substrate 201 with a crystal orientation of (110), for forming the flow path forming substrate 1, having a thickness of 220 $\mu$m is heated to 1100° C. for 60 minutes in an oxygen atmosphere containing water vapor to form silicon oxide films 207 each having a thickness of 1 μm on both sides of the single-crystal Si substrate 102 through thermal oxidation. The silicon oxide film 207 serves as an insulating film of an active element formed thereon and also as an etching mask when the single-crystal Si substrate 102 is to be etched. The etching mask should not be limited to the silicon oxide film, but may be any film (single-crystal Si etch-resistant film) such as a silicon nitride film or metallic film as long as it has resistance to an Si etching liquid.

On the single-crystal Si substrate 102 with the silicon oxide film 207 formed, a zirconium film is formed by sputtering. The zirconium film is oxidized by thermal oxidation to provide a zirconium oxide having a thickness of about 0.8 μm, thereby forming a film 201 for forming the vibrating plate 2.

Further, a platinum (Pt) film having a thickness of 0.2 μm is formed on the film 201 to provide a film 202 for forming the lower electrode 6. Likewise, on the film 202, a piezoelectric film 203 of a zircon oxide titanium film (PZT) having a thickness of 1 μm is formed. On the piezoelectric film 203, an aluminum film having a thickness of 0.2 μm is formed to provide a film 204 for forming the upper electrode 7. In order to improve the contact strength between the adjacent films, an intermediate layer of titanium (Ti), titanium oxide (TiO) and chrome (Cr) may be laminated between the adjacent films.

As shown in FIG. 3(*b*), photoresist (not shown) is applied to the entire surface of the film 204, piezoelectric film 203 and film 202 by spin coating. The photoresist applied is patterned in a desired shape, now corresponding to the pressure generating chambers by photolithography and etching. In making such a pattern, patterning may be effected for each of the film 202, piezoelectric film 203 and film 204 and thereafter these films may be laminated.

Hereinafter, the surface on the side of the single-crystal Si substrate 102 where the piezoelectric film 203 is formed is referred to as the "active surface" and the face opposite thereto is referred to as the "non-active surface".

As shown in FIG. 3(*c*), positive-type photoresists 209 and 208, which are generally used, are applied to the entire active and non-active surfaces, respectively. In this case, application of the photoresist may be carried out by roll coating. The photoresist 209 on the active surface serves to protect a silicon oxide film from being etched. The substrate is subjected to pre-baking at a temperature of 80° for 10 minutes.

Figure 7A:
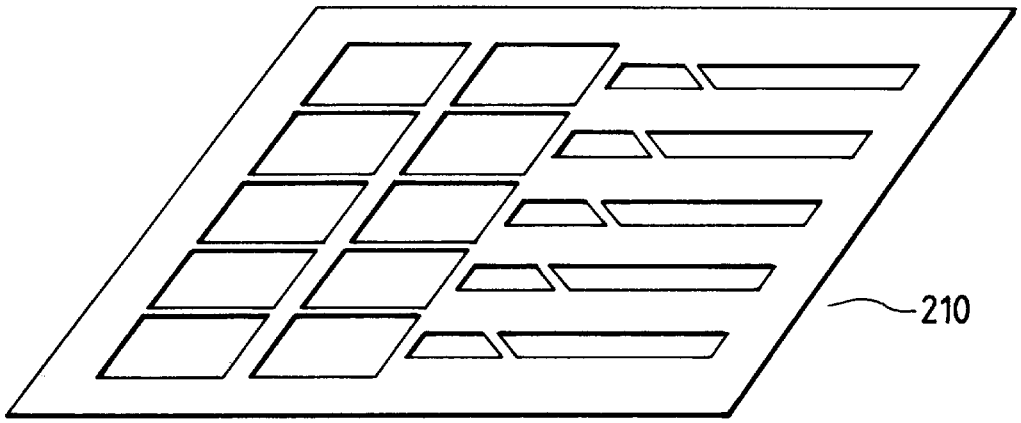
FIG. 7(*a*) and FIG. 7(*b*) are plan views for a glass mask which is used in a method for fabricating the ink jet recording head according to the present invention.
Figure 7B:
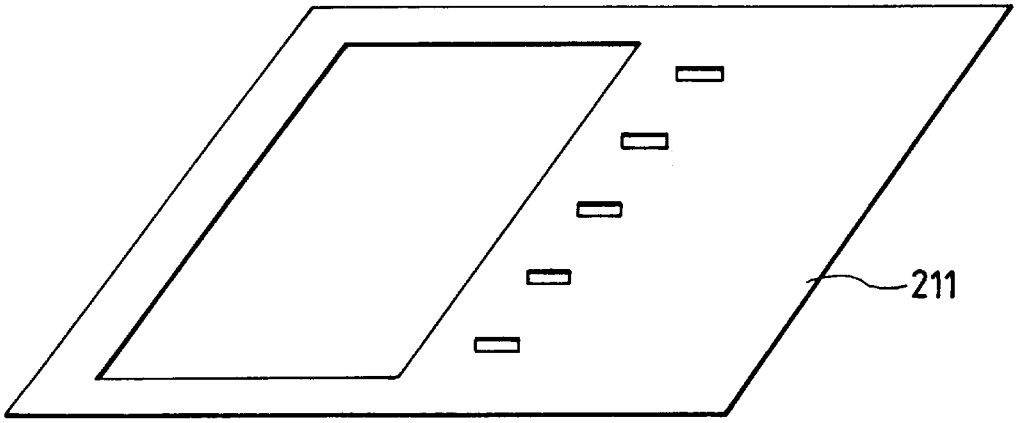

As shown in FIG. 3(*d*), the photoresist 208 is covered with a glass mask 210 having a desired pattern and irradiated with ultraviolet rays. In the glass mask 210, the areas where the ultraviolet rays permeate are indicated by a solid slender line and the areas from which they are reflected are indicated by a bold solid line. The plan view of the glass mask is shown in FIG. 7(*a*).

Figure 4A:
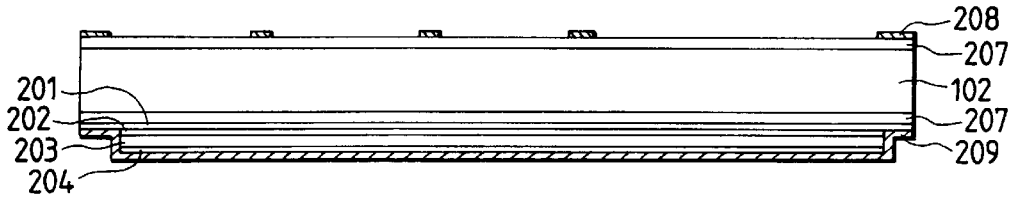
FIG. 4(*a*) to FIG. 4(*c*) are sectional views showing the process of fabricating the ink jet recording head according to the present invention.
Figure 4B:
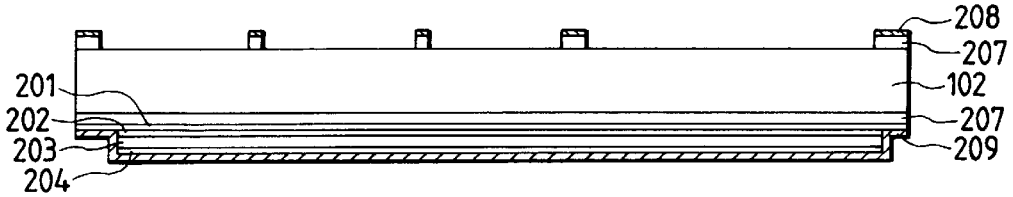
Figure 4C:
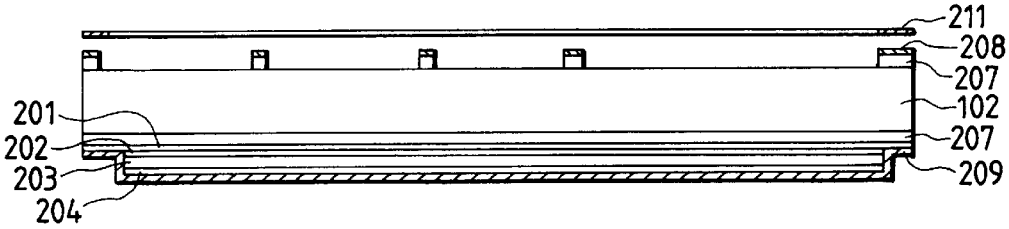

As shown in FIG. 4(*a*), the positive-type photoresists 209 and 208 are developed. The development is carried out in such a manner that the substrate is immersed in a usual alkaline development liquid while the liquid is stirred and swung for one minute and 30 seconds at room temperature. Thereafter, the substrate is subjected to post baking at 140° C. for ten minutes.

As shown in FIG. 4(*b*), the silicon oxide film 207 is patterned by etching using buffering hydrofluoric acid. In this case, the silicon oxide film 207 having a thickness of about 1 μm can be patterned by etching for ten minutes.

As shown in FIG. 4(*c*), the patterned photoresist 208 is covered with a glass mask 211 having a pattern corresponding to the reservoir 5 and the ink supply paths 8, and irradiated with ultraviolet rays. The plan view of the glass mask is shown in FIG. 7(*b*).

Figure 5A:
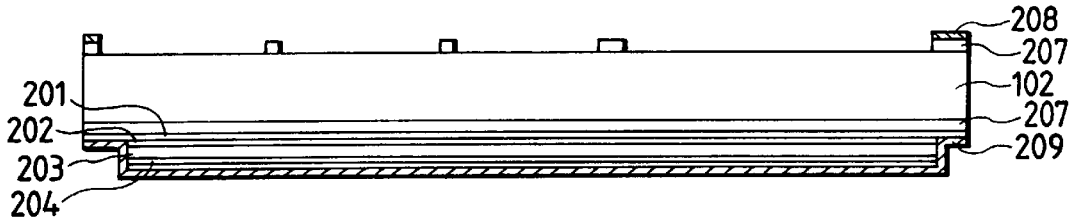
FIG. 5(*a*) to FIG. 5(*c*) are sectional views showing the process of fabricating the ink jet recording head according to the present invention.
Figure 5B:
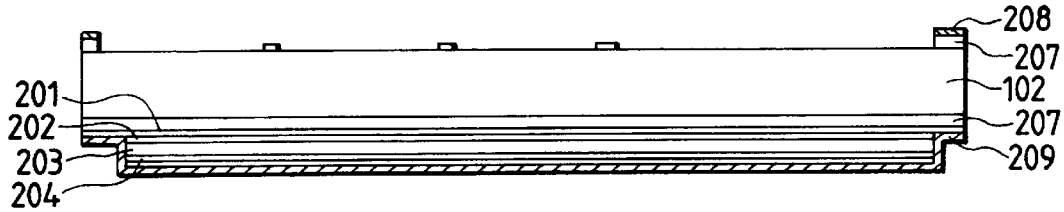
Figure 5C:
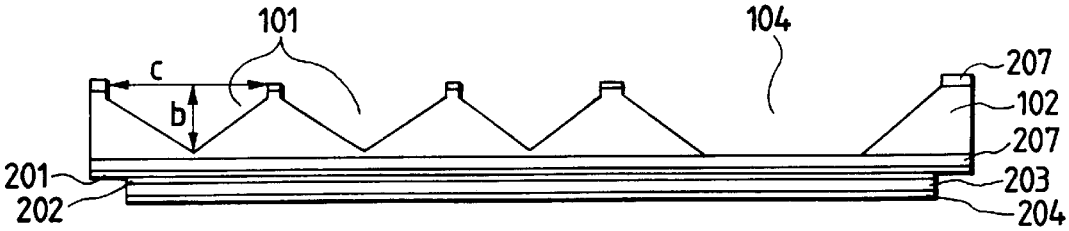

As shown in FIG. 5(*a*), the positive-type photoresist is developed. As described above, the development is carried out in such a manner that the substrate is immersed in a usual alkaline development liquid while the liquid is stirred and swung for one minute and 30 seconds at room temperature. Thereafter, the substrate is subjected to post baking at 140° C. for ten minutes.

As shown in FIG. 5(*b*), the positive-type photoresists 209 and 208 are developed.

As shown in FIG. 5(*b*), the silicon oxide film 207 of the developed/removed areas of the positive-type photoresist is patterned by half-etching using buffering hydrofluoric acid. In this case, the thickness of about 1 μm of the silicon oxide film 207 is reduced to about 0.5 μm by etching for five minutes. The photoresist other than the patterned area is exposed to light and developed again. The technique of forming areas having different thicknesses is referred to as multiple light exposure. This step permits the silicon oxide film 207 to be removed in the step of FIG. 6(*a*).

After the photoresists 208 and 209 are removed using removal liquid or ashing, as shown in FIG. 5(*c*), the single-crystal Si substrate 102 is anisotropically etched using an alkaline liquid. Thus, grooves 104 and 101 constituting the pressure generating chamber 4 and reservoir 5, respectively are formed. This is because when the single-crystal Si substrate 102 having a plane orientation of (110) is etched using the alkaline liquid, a (111) plane appears at an angle of 35° from the plane of (110) to stop further etching.

Therefore, as shown in FIG. 5(*c*), the depth b of the groove to be etched at the deepest position defines the distance c between both edges of the groove to be etched. Thus, by changing the distance c between both edges, the thickness of the single-crystal Si substrate 102 can be freely designed. Since the depth of the reservoir depends on the distance c in FIG. 5(*c*), the depth of the reservoir 5 can be controlled accurately. Such a structure is very advantageous in view of assuring accuracy. Now, when the single-crystal Si substrate 102 is anisotropically etched using the alkaline liquid, the silicon oxide film 207 is also etched to reduce its thickness by about 0.4 μm. Thus, the silicon oxide film 207 has a pattern 0.1 μm at the area constituting the ink supply paths. The silicon oxide film 207 at the remaining areas has a thickness of about 0.6 μm.

Figure 6A:
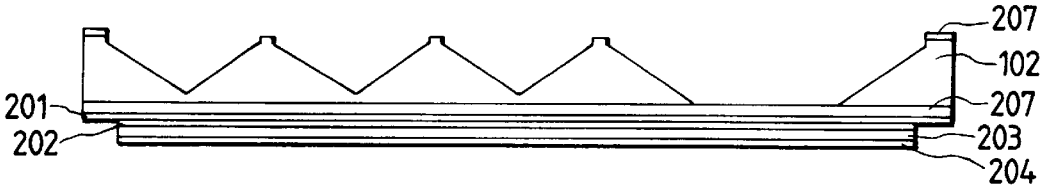
FIG. 6(*a*) to FIG. 6(*c*) are sectional views showing the process of fabricating the ink jet recording head according to the present invention.
Figure 6B:
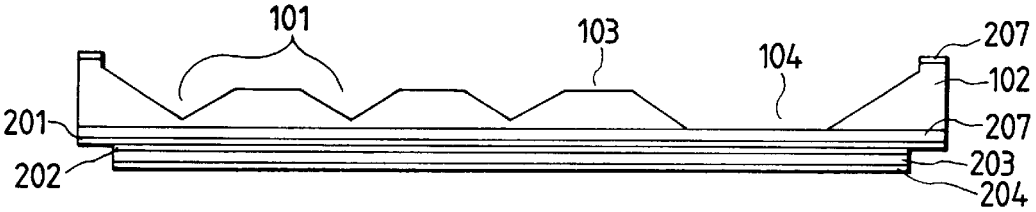
Figure 6C:
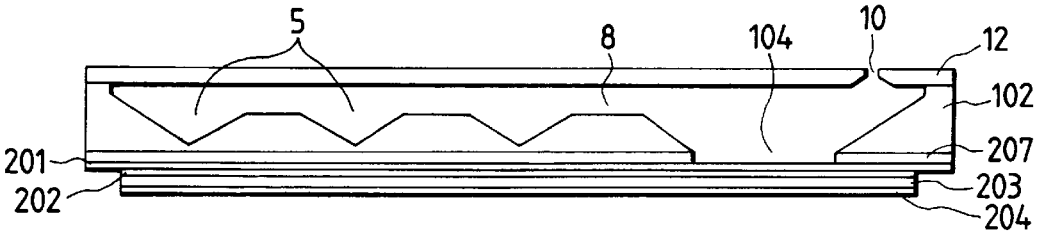

As shown in FIG. 6(*a*), the substrate is immersed in a buffering hydrofluoric acid liquid for one minute to etch the silicon oxide film 207. Thus, the silicon oxide film 207 at the areas where the ink supply paths 8 and the reservoir 5 are to be formed is removed whereas the remaining silicon oxide film 207 is left with a thickness of about 0.5 μm.

As shown in FIG. 6(*b*), in order to form the areas 103 and 101 constituting the ink supply paths 8 and the reservoir 5, the substrate 102 is immersed in an alkaline liquid for its etching.

The process of the steps described above permits a plurality of units to be formed simultaneously in a Si wafer. This process, however, is excellent for achieving mass production and low cost.

As shown in FIG. 6(*c*), where the plurality of units have been formed in the Si wafer, the units are separated from one another. Nozzle plates 12 of stainless or plastic each with a nozzle opening 10 are bonded together to complete an ink jet recording head.

Before the fabricating process is shifted from the step of FIG. 6(*b*) to FIG. 6(*c*), in this embodiment, the portions of the silicon oxide film 207 remaining on the non-active area and pressure generating chambers 4 have been removed. But, with the portions being left as they are, the nozzle plates 12 may be bonded together as shown in FIG. 6(*c*).

In the fabricating process described above, a potassium hydroxide (KOH) water solution-having a concentration of 10% weight at 80° C. was used for the first etching for the single-crystal Si substrate 102, another potassium (KOH) water solution having a concentration of 40% weight at 80° C. was used for the second etching for the single-crystal Si; and a buffering hydrofluoric acid (HF) solution having 16% weight at room temperature was used for the silicon oxide film 207. In the condition described above, the etching rate of the single-crystal Si substrate 102 in the HF solution was 2.3 Am/min, and that of silicon oxide film 207 was 0.1 $\mu$m/min. In the first alkaline etching, the single-crystal Si was etched by 220 $\mu$m to form the deepest portion of each pressure generating chamber 4. Then, the ink supply paths 8, which are covered with the silicon oxide film 207, are not formed. The reservoir 5 is partially formed through the anisotropic etching. Further, the non-etched silicon oxide film 207 is subjected to photolithography. In the second alkaline etching (half-etching), the single-crystal Si was etched by 100 $\mu$m. Thus, in the step of FIG. 6(*b*), the ink supply paths 8 and reservoir 5 of the ink jet recording head were formed.

The above method precisely controls the groove depth of the reservoir 5. Further, even if the mechanical strength of the Si substrate is small, the reservoir does not become faulty from the vibration during the post fabricating step and transportation.

An explanation will be given of the ink jet recording apparatus using the ink jet recording head described above.

Figure 8:
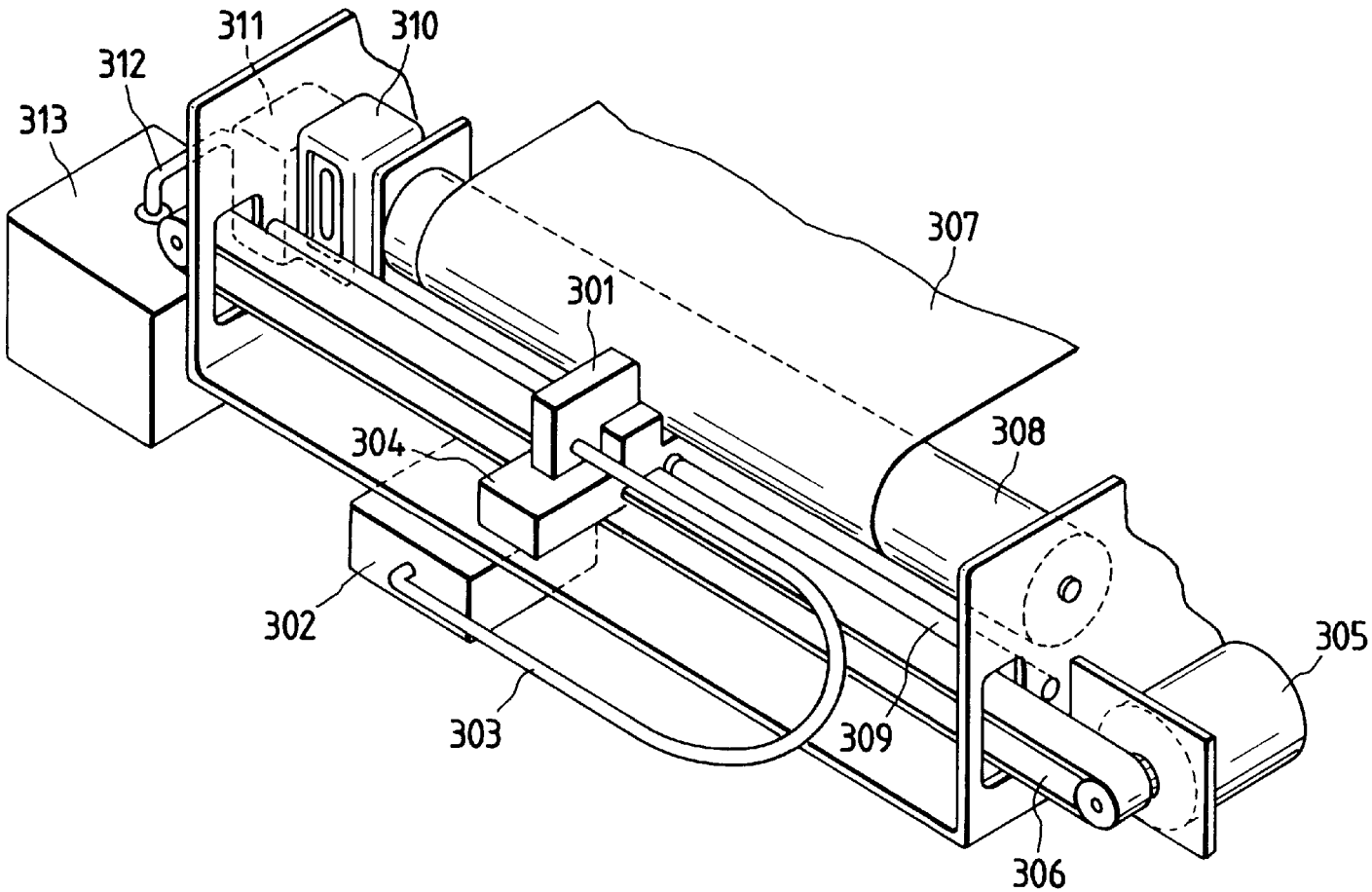
FIG. 8 is a perspective view showing an example of how the ink jet recording head may be applied.
Figure 9A:
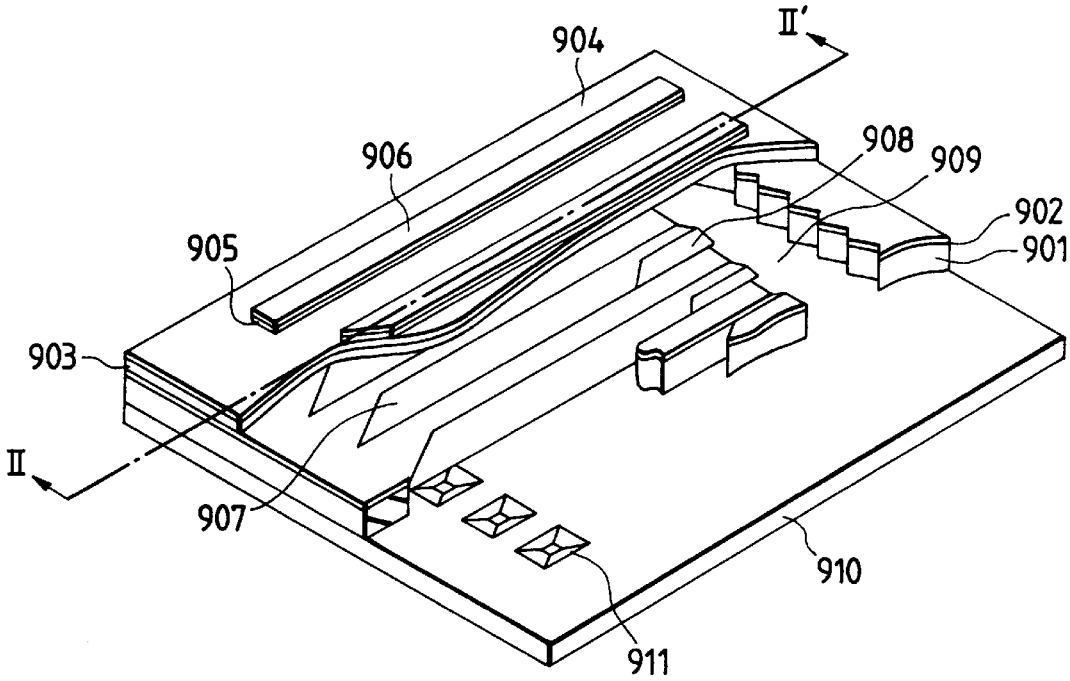
FIG. 9(a) PRIOR ART
FIG. 9(*a*) is a perspective view of a conventional ink jet recording head and FIG. 9(*b*) is a sectional view taken along line II—II' in FIG. 9(*a*).
Figure 9B:
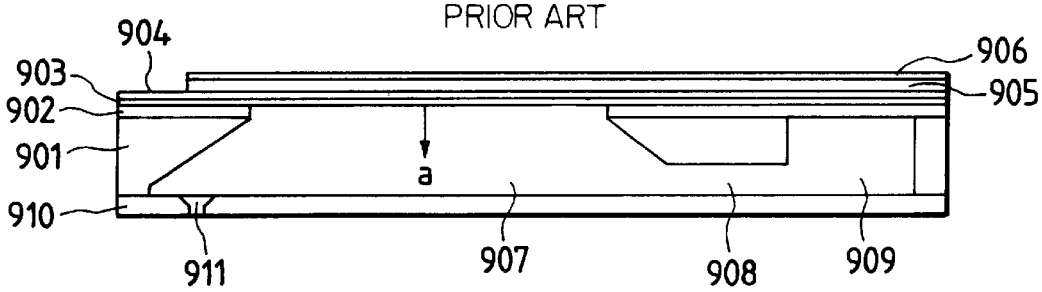
FIG. 9(b) PRIOR ART

FIG. 8 is a perspective view of the ink jet recording apparatus incorporating the ink jet recording head according to the present invention. In FIG. 8, a recording head 301 is mounted on a carriage 304 secured to a timing belt 306 driven by a motor 305 and is designed to reciprocate in a width direction of a recording sheet of paper 307 transported by a platen 308 while being guided by a guide 309. The recording head 301 is supplied with ink necessary for jetting from an ink cartridge 302 containing an ink composition through an ink supply tube 303.

A capping device 310 serves to prevent clogging of the nozzle opening for discharging of ink drops when the recording head is in a non-printing state, and is connected to a sucking pump 311 to jet ink from the recording head 301, thereby relieving the clogging. A sucking pump 311 is connected to a waste ink tank 313 by a tube 312.

The ink jet recording head according to the present invention can be applied to an ink jet recording apparatus with an ink cartridge mounted on the carriage, or with a recording head and an ink cartridge integrally formed.

What is claimed is:

1. An ink jet recording head comprising:

a nozzle plate having a plurality of nozzle openings for discharging ink;

a flow-path forming plate including a plurality of pressure generating chambers communicating with said nozzle openings, respectively, ink supply paths communicating with said pressure generating chambers for supplying ink to said pressure generating chambers and reservoirs communicating with said ink supply paths;

a vibrating plate formed on said flow-path forming plate, said vibrating plate having portions which face said pressure generating chambers;

thin film piezoelectric elements having electrodes and piezoelectric films formed at the portion of said vibrating plate corresponding to said pressure generating chambers, wherein said reservoirs include a common ink chamber and a plurality of grooves, and said grooves are arranged below said common ink chamber in a thickness direction of said flow path forming plate, wherein said thickness direction extends between said nozzle plate and said vibrating plate.

2. An ink jet recording head according to claim 1, wherein said flow-path forming plate is made of single-crystal silicon (Si).

3. An ink-jet recording head according to claim 2, wherein said single crystal Si plate is in a (110) plane orientation and at least one wall faces of each of the grooves is in a (111) plane orientation.

4. An ink jet recording head according to claim 1, wherein said grooves are formed at the same pitch as that of said pressure generating chambers.

5. An ink jet recording head according to claim 1, wherein said grooves include walls formed therein, said walls are formed to have a lattice shape in said reservoir.

6. An ink-jet recording head according to claim 2, wherein the plurality of grooves are partitioned by first walls extending in a longitudinal direction of said pressure generating chambers and second walls extending in the direction of arrangement of the pressure generating chambers, and the width of the second walls of said grooves is larger than a width of said first walls.

7. An ink jet recording head according to claim 1, wherein said common ink chamber has a depth equal to that of said ink supply paths.

8. An ink jet recording head according to claim 1, wherein said grooves extend in a direction of arrangement of the pressure generating chambers.

9. An ink jet recording head according to claim 1, wherein said grooves are triangle-shaped.

10. An ink jet recording apparatus comprising:

an ink jet recording head; and a timing belt, wherein said ink jet recording head comprises:

a nozzle plate having a plurality of nozzle openings for discharging ink;

a flow-path forming plate including a plurality of pressure generating chambers communicating with said nozzle openings, respectively, ink supply paths communicating with said pressure generating chambers for supplying ink to said pressure generating chambers and reservoirs communicating with said ink supply paths;

a vibrating plate formed on said flow-path forming plate, said vibrating plate having portions which face said pressure generating chambers; and thin film piezoelectric elements having electrodes and piezoelectric films formed at the portion of said vibrating plate corresponding to said pressure generating chambers, wherein said reservoirs include a common ink chamber and a plurality of grooves, said grooves are arranged below said common ink chamber in a thickness direction of said flow path forming plate; and said grooves include walls formed therein, wherein said thickness direction extends between said nozzle plate and said vibrating plate.

11. An ink jet recording apparatus according to claim 10, wherein said flow-path forming plate is made of single-crystal silicon (Si).

12. An ink jet recording apparatus according to claim 11, wherein said single-crystal Si plate is in an (110) plane orientation and the one of each of the grooves is in an (111) plane orientation.

13. An ink jet recording apparatus according to claim 10, wherein said grooves are formed at the same pitch as that of said pressure generating chambers.

14. An ink jet recording apparatus according to claim 10, wherein said walls of said grooves are formed to have a lattice shape in said reservoir.

15. An ink-jet recording apparatus according to claim 10, wherein the plurality of grooves are partitioned by first walls extending in a longitudinal direction of said pressure generating chambers and second walls extending in the direction of arrangement of the pressure generating chambers, and the width of the second walls of said grooves is larger than a width of said first walls.

16. An ink jet recording apparatus according to claim 10, wherein said common ink chamber has a depth equal to that of said ink supply paths.

17. An ink jet recording head according to claim 10, wherein said grooves extend in a direction of arrangement of the pressure generating chambers.

18. An ink jet recording head according to claim 10, wherein said grooves are triangle-shaped.

* * * * *